United States Patent [19]

Sumar

[11] Patent Number: 4,562,694

[45] Date of Patent: Jan. 7, 1986

[54] DEVICE FOR ATTACHMENT TO DRAWTWISTER MACHINES TO PRODUCE MULTIFILAMENT YARNS WITH S OR Z TWIST EFFECT

[76] Inventor: Cesar P. Sumar, El Pinar 172, Santiago, Chile

[21] Appl. No.: 511,703

[22] Filed: Jul. 7, 1983

[51] Int. Cl.[4] ..... D02G 1/08; D02G 1/02; D01H 7/92

[52] U.S. Cl. ..... 57/288; 57/310; 57/331

[58] Field of Search ..... 57/282, 284, 287, 288, 57/310, 315, 328, 330, 331, 332, 334

[56] References Cited

U.S. PATENT DOCUMENTS

| | | | |
|---|---|---|---|
| Re. 28,117 | 8/1974 | Rice | 57/288 |
| 2,979,882 | 4/1961 | Bromley et al. | 57/310 |
| 2,988,866 | 6/1961 | Kleekamm | 57/310 |
| 3,247,662 | 4/1966 | Jaeggli | 57/310 X |
| 3,680,302 | 8/1972 | Hess et al. | 57/310 |
| 3,735,575 | 5/1973 | Hattori | 57/334 X |
| 3,782,090 | 1/1974 | Edwin et al. | 57/288 |
| 3,816,989 | 6/1974 | Rice | 57/310 X |

*Primary Examiner*—Donald Watkins
*Attorney, Agent, or Firm*—Cushman, Darby & Cushman

[57] ABSTRACT

The present invention relates to the manufacture of textile multifilament yarns and, in particular, to a device for twisting multifilament yarns in conventional drawtwister machines. The device includes a pair of twisting rollers mounted to rotate freely on shafts, the axis of which are arranged with a substantial angle between them and in spaced apart and parallel planes. One twisting roll is a straight cylinder mounted on a fixed shaft whose axis is perpendicular to a supporting plate. The other is a frustrum with concave walls and a determined radius of curvature and is mounted on a shaft whose axis is parallel to the surface of the supporting plate.

The supporting plate of the twisting device is installed on a surface of the drawtwister machine so that the shaft of the concave roll forms an angle of about 40°-50° relative to an imaginary line connecting the yarn fastening roller and the surface of the godet. Twist in the yarn is set by heating the filament by of a suitable heating element before the yarn passes around the twisting rollers.

7 Claims, 5 Drawing Figures

DEVICE FOR ATTACHMENT TO DRAWTWISTER MACHINES TO PRODUCE MULTIFILAMENT YARNS WITH S OR Z TWIST EFFECT

FIELD OF THE INVENTION

The present invention relates to the manufacture of textile multifilament yarns and, in particular, to a device for twisting multifilament yarns in conventional drawtwister machines.

DESCRIPTION OF THE PRIOR ART

Conventionally, textile yarns employed, for instance, in the manufacture of panty-hoses and stockings for women are subjected to a twisting process in order to provide said yarns elasticity and fluffiness ("torque") in the yarns, giving the resulting fabric a great transparency, elasticity and softness. The process of false twisting or texturization, with either S or Z twists, is carried out in special machines which produce the desired twist by means of magnetic spindles or friction discs. The machines equipped with magnetic spindles work at speeds ranging from 800,000 to 1,000,000 rpm. in order to produce multifilament yarns of approximately 1,000–5,000 twists per meter. Given:

$$N(\text{rpm})/\text{t.p.m.} = \text{meters/minute}$$

where

N = speed of the magnetic spindle, and t.p.m. = twist per meter of yarn.

It is inferred that the productivity of conventional texturing machines does not exceed 300–500 meters of yarn/minute in each spindle. Conventional texturizing machines are mechanically sophisticated exhibiting high technology; therefore, their initial cost is very high. Furthermore, due to their complexity, maintenance and service are very expensive requiring a high cost final product. Attempts to manufacture twisted yarns using drawtwister machines have failed and, in general, this idea has been abandoned by the experts in this art.

Only one attempt of using drawtwister machines equipped with an additional and special device is known. It has been tried to twist monofilament yarns with these machines, making the yarn to run through two cylinder rolls arranged perpendicularly with their shafts in two parallel planes.

Such a device does not allow the twisting of multifilament yarns.

ADVANTAGES OF THE INVENTION

The object of the present invention is to provide a simple and low cost device, which can be attached to drawtwister machines to manufacture twisted multifilament yarns with either S or Z twist. The present invention permits a high productivity to be achieved in machines equipped with the twisting device in comparison with the productivity obtained with conventional machines.

The productivity obtained reaches approximately 600–900 meters of yarn/min., in each device, in comparison with the 300/500 m/minute obtained in the conventional machines equipped with magnetic spindles. The device of the present invention enables to obtain a low unit cost of production in comparison with those obtained with conventional machines.

The multifilament yarn twisted with the device of the present invention is of high quality, with a great number of twists per meter, and of good elasticity (in the range of 5–25%), making it possible to obtain fabrics for panty-hoses, stockings and the like of great transparency and smoothness.

Conventional drawtwister machines equipped with the twisting device of the present invention operate with a low energy consumption in comparison with the high energy consumption of the conventional texturizing machines. The device of the present invention is very simple, small and of low cost.

The present invention enables in situ a modification of existing drawtwister machines, transforming them into machines that at a very low cost and without delay of time caused by stopping the manufacturing procedure, provide a special type of yarn highly suitable for manufacturing panty-hose or stockings and the like. The operating process in the modification drawtwister machines according to the present invention is very simple in comparison with the process employed for instance, in magnetic spindles machines ("texturizers").

SUMMARY OF THE INVENTION

The device of the present invention includes a pair of twisting rollers mounted to rotate freely in shafts, the axis of which are arranged at a substantial angle between them, the shafts being in spaced apart and parallel planes. One of the twisting rolls is a straight cylinder mounted on a fixed shaft whose axis is perpendicular to a supporting plate and the other a frustrum with concave walls and with a determined radius of curvature mounted on a shaft whose axis is parallel to the surface of the supporting plate.

The supporting plate of the twisting device is installed on a surface of the drawtwister machine so that the shaft of the concave roll forms an angle of about 40°–50° relative to an imaginary line connecting the yarn fastening roller and the surface of the godet. The twist of the yarn is set by heating the filament by a suitable heating element which heats the yarn before it passes around the twisting rollers.

BRIEF DESCRIPTION OF THE DRAWINGS

The present invention will be described with reference to the attached drawings, in which.

DETAILED DESCRIPTION OF THE INVENTION

Figure 1:
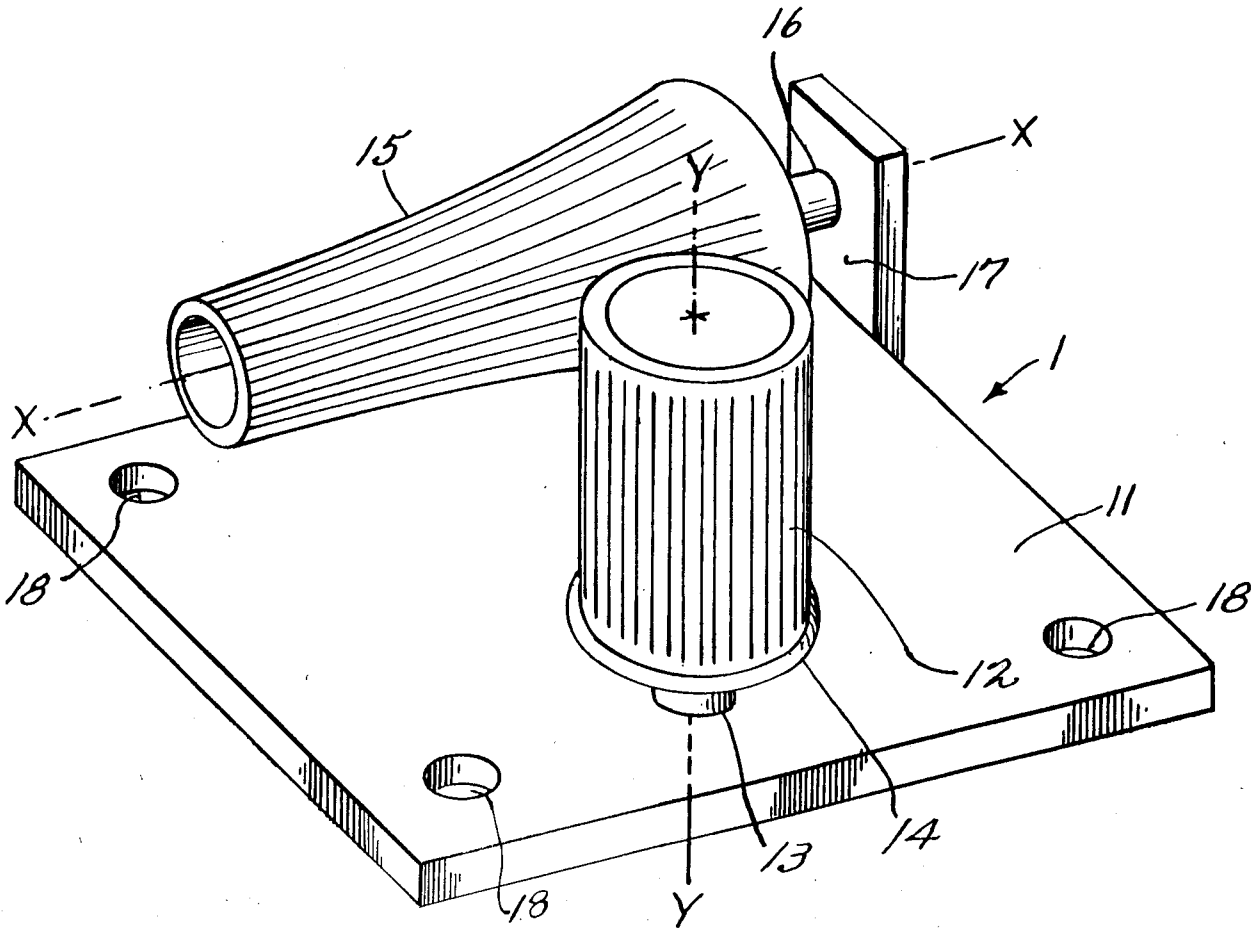
FIG. 1 is a view from above, showing schematically the twisting device according to the invention for the manufacture of yarns with "S" twist.

As shown in FIG. 1, the twisting device 1, according to the invention, comprises a base plate 11 having a substantially square shape where a cylindrical roll 12 is mounted to rotate freely around a shaft 13 which extends along the Y—Y axis of the cylindrical roll 12. Preferably, but not necessarily, cylindrical roll 12 can be hollow and furnished with a flange 14 on the end adjacent plate 11; which projects radially outwardly from the surface of the lateral walls of the cylindrical roller.

Figure 3:
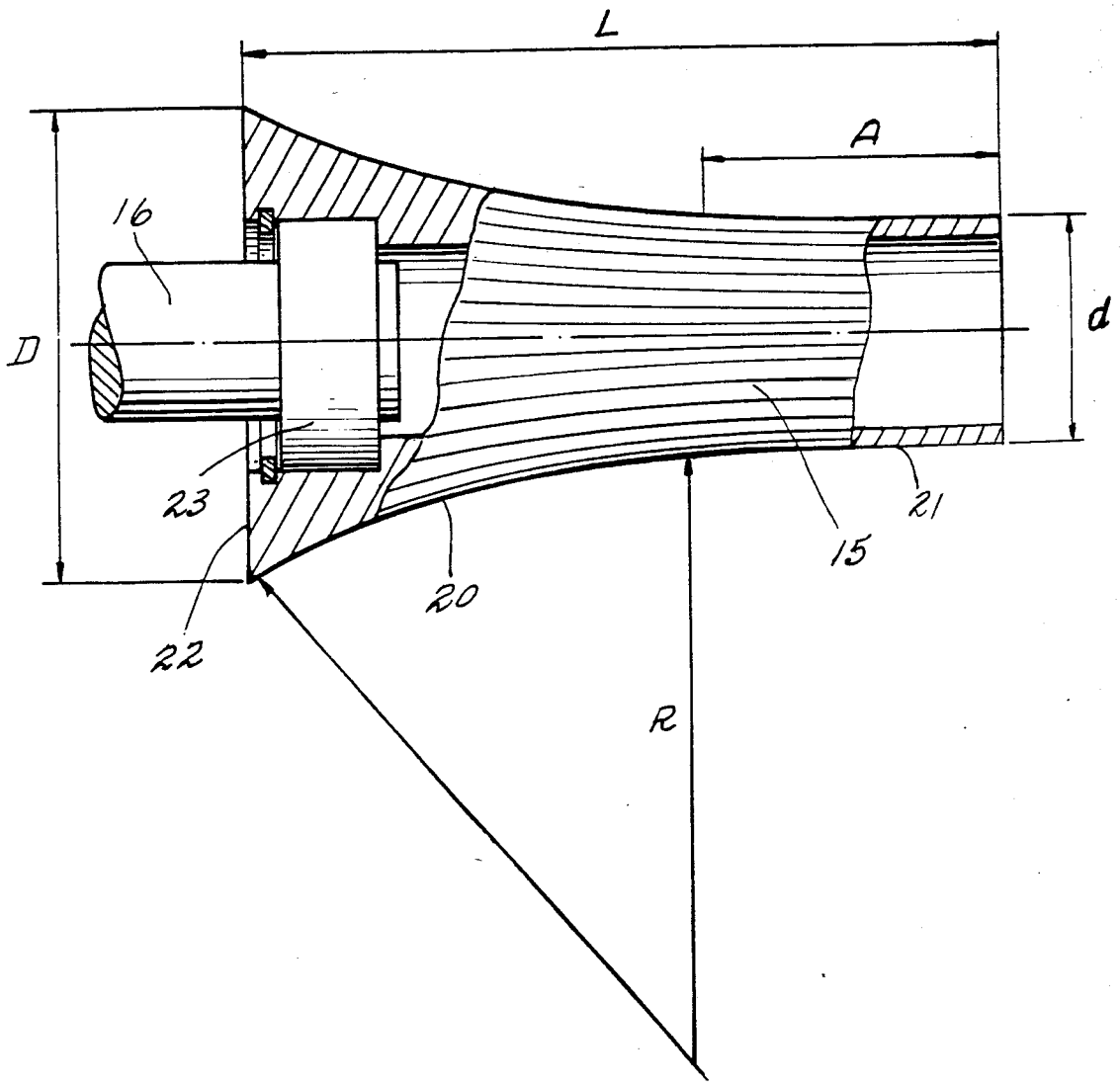
FIG. 3 is a plan view, partially in section, illustrating the shape and general dimensions of the concave frustrum twistng roll employed in the device of the invention.

A twisting roll 15 is located laterally spaced from the cylindrical roll 12 and has substantially the shape of a frustrum having slightly concave lateral walls. Twisting roll 15 is shown in FIG. 3 in greater detail.

The shaft 16 of twisting roll 15, which extends along the X—X axis, forms a substantially right angle relative to shaft 13 (axis Y—Y cylindrical roll 12) and consequently lies substantially parallel to the upper face of base plate 11.

The conical-concave roll 15 is mounted to rotate freely around shaft 16 which is fixed to a console 17 located at a substantially right angle relative to the upper face of base plate 11. In order to simplify the installation of the twisting rolls in a surface of a drawtwister machine, the base plate 11 can be furnished with holes 18, through which bolts (not shown) can be screwed into the drawtwister machine.

Figure 2:
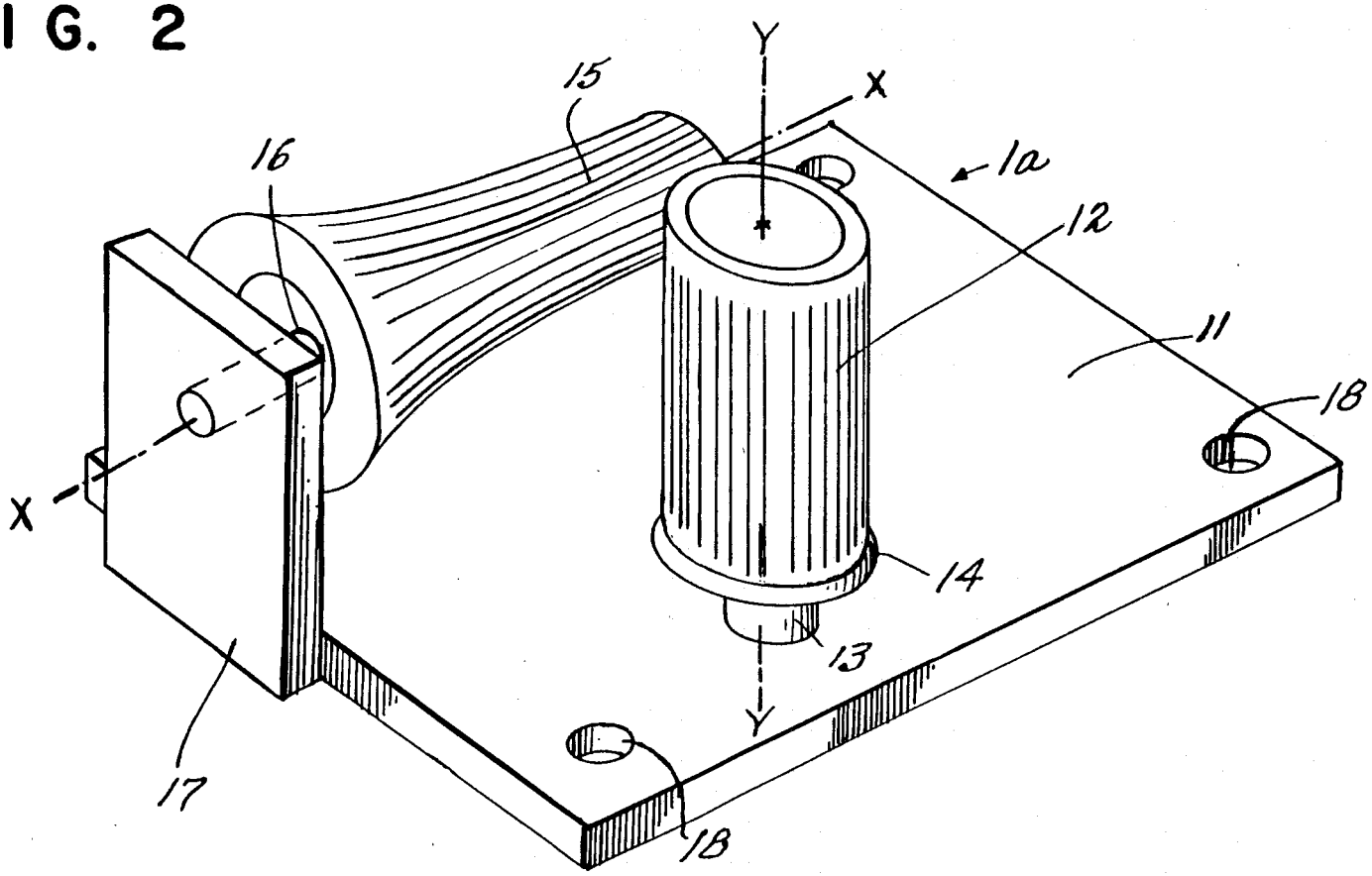
FIG. 2, similar to FIG. 1, shows the twisting device for the manufacturing of yarn with "Z" twist.

The position of the rolls 12 and 15 which are shown in FIG. 1, comprise a twisting device for producing yarns with "S" twist. FIG. 2 shows a device 1*a* in which can be observed that the conical-concave roll 15 is installed with its axial shaft X—X located in a totally opposed position with respect to the position shown in FIG. 1. This FIG. 2 location for rolls 12 and 15 comprise a twisting device for producing yarn with Z twist.

In FIG. 3, the twisting roll 15 is shown schematically and partially, in a section view. The body of the roll has a substantially truncated shape, being preferentially hollow and with lateral walls defined by a concave zone 20, with a radius of curvature R and a cylindrical zone 21 of length A and diameter d; the base 22 of the twisting roll 15, of diameter D, is provided with a bearing 23, for instance, of the needle type or similar, which enables the twisting roll 15 to rotate freely around shaft 16.

It has been discovered that, advantageously, the dimensions which define the geometry of the twisting roll 15, have the following relations between them, as illustrated in FIG. 3:

$$d/D=\tfrac{2}{3};\ D/L=3/5;$$

$$A/L=2/5;$$

$$\tfrac{5}{8}\leqq D/R\leqq 5/11$$

Preferentially, the length L of the conical-concave twisting roll 15 is between 20 and 90 mm. Twisting rolls 12 and 15 are preferably made of a metalic material with a suitable surface hardness such as, for instance, stainless steel, monel metal or similar.

Figure 4:
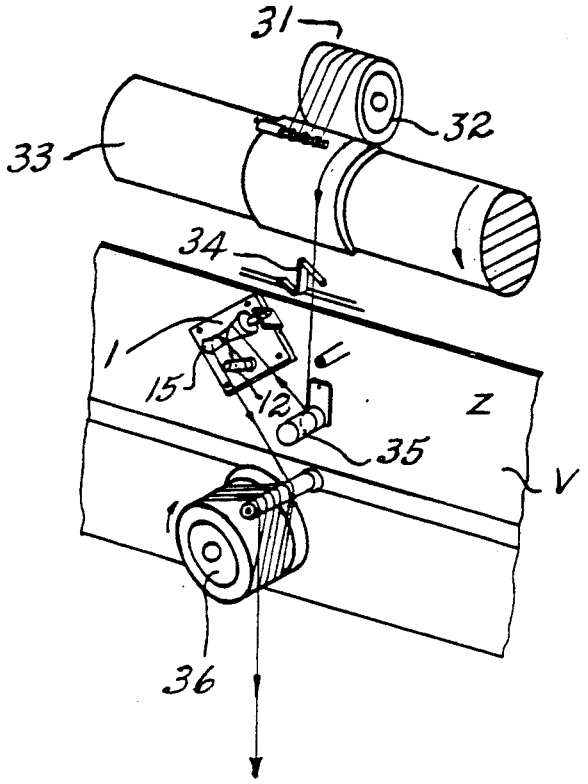
FIG. 4 is a partial perspective and schematic view of a portion of a conventional drawtwister machine where a twisting device is installed for the manufacturing of yarns with "S" twist and FIG. 5 is a perspective view similar to FIG. 4 illustrating a twisting device for the manufacturing of yarns with "Z" twist.

It has also been discovered that a better twist effect on the yarn is obtained if the surface finish of the cylinder walls is of the nonbrilliant type ("dull") with a very slight rugosity or wrinkled surface. In FIG. 4, a twisting device 1 as in FIG. 1 is shown which has been placed on the vertical surface V of a drawtwister machine.

A continous textile yarn of syntetic fiber 13, fed from a creel (not shown) is wound around a fastening roll 32, which is frictionally driven by the impeller 33 which rotates at a predetermined angular speed. The yarn 31, after making contact with one yarn guide 34, is wound (one or more times) around a heating element 35. The heating element 35, operated by electricity or by other suitable means, can rotate, if desired, freely around its axle due to the frictional drive of yarn 31, as will be later explained.

The yarn 31, after being heated when running over the heater 35, is caused to pass around the conical-concave twisting roll 15, around the cylindrical roll 12, again around the twisting roll 15 and finally is wound four or five times around the driven godet 36 which rotates at an angular speed between 1.1 and 5 times greater than the angular speed of the impeller shaft 33.

The greater angular speed of the godet 36 relative to impeller shaft 36 causes a yarn 31 to be drawn in a conventional way already known in the art.

The friction resulting from the drive of yarn 31 around the heater 35 causes the heating reel to rotate freely. The yarn 31 is heated up to the proper temperature to set up the twist on the yarn 31 which will be produced by means of the conical-concave twisting roll 15 and the cylindrical roll 12; the rollers rotating freely under the action of the frictional drive produced by the yarn 31. The drive of the yarn at high linear speed on the conical-concave twisting roll 15 causes the yarn to slide up and down on the concave surface 20 of the roll 15, thus producing an "S" twist effect on the yarn 31 which twist is due to the temperature provided by heater 35.

The yarn 31, already twisted, is transferred from the godet 36 to a cops or winder cylinder (not shown) and later is knit by in circular machines to manufacture of panty-hose stockings and other products.

Figure 5:
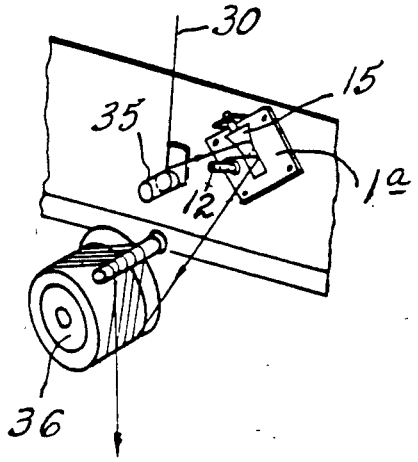

FIG. 5 illustrates the position of the device 1*a* of FIG. 2, in which Z twist is obtained on the yarn 31 in the same way that device 1 (shown in FIG. 4), produces S twist.

It should be understood that experts in the art can visualize changes and/or modifications either in the details of the design or in the details of the construction, shape or dimensions without those changes and/or modifications being out of the spirit and scope of the invention.

I claim:

1. A device to be attached to drawtwister machines for drawtwisting synthetic textile multifilament yarns to produce yarns with S or Z twist, said device comprising a mounting plate, a cylindrical roll which can rotate freely around a shaft secured to said plate and a roll in the form of a substantially truncated cone whose lateral walls are defined by a conical-concave zone and a cylindrical zone, which truncated roller can rotate freely around a shaft secured to said plate and positioned at a substantially right angle to the shaft of said cylindrical roll, said truncated roller being spaced a predetermined distance from said cylindrical roll.

2. A device as claimed in claim 1, wherein said cylindrical roll and said truncated roll are hollow.

3. A device as claimed in claim 1, wherein said cylindrical roll is provided with a rounded flange at its lower end proximate to the surface of said plate, which projects radially outwardly from the cylinder walls.

4. A device as claimed in claim 1, wherein said truncated roll has a length (L), a base diameter (D), a free end diameter (d), and a cylindrical zone length (A), so that the following dimensional relationship is established:

$$d/D=\tfrac{2}{3}$$

$D/L=3/5$ $A/L=2/5$ wherein said length (L) is in the range of 20 to 90 mm and the radius of curvature (R) of the concave walls is as follows:

$\frac{5}{8} \leqq D/R \leqq 5/11.$

5. A device as claimed in claim 1, further in combination with a drawtwister machine including a yarn fastening roller and a godet mounted adjacent said device on the drawtwister machine so that said device is positioned within the yarn path of the drawtwister between the yarn fastening cylinder and the godet, the shaft of said truncated roller forming an angle in the range of about 40°–60° relative to the yarn which is driven by the godet from said yarn fastening cylinder, and the shaft of said cylindrical roll is arranged substantially transversally relative to the yarn.

6. A device as in claim 5 in combination with a drawtwister machine for synthetic textile multifilament yarns which has been equipped with one or more of said devices wherein said device is mounted to the left of the yarn path exiting said yarn fastening roller to produce yarns with S twist, said yarn being wound around a heater before being wound around said cylindrical and truncated rolls.

7. A device as in claim 5 in combination with a drawtwister machine for synthetic textile multifilament yarns which has been equipped with one or more of said devices wherein the device is mounted to the right of the yarn path exiting said yarn fastening roller to produce yarns with Z twist, said yarn being wound around a heater before being wound around said cylindrical and truncated rolls.

* * * * *